US008413403B2

(12) United States Patent
Walker, III et al.

(10) Patent No.: US 8,413,403 B2
(45) Date of Patent: Apr. 9, 2013

(54) CURTAINWALL SYSTEM

(75) Inventors: John Robert Walker, III, Plymouth, MN (US); David A. Niemoeller, St. Louis, MS (US); Michel Michno, Bloomington, MN (US)

(73) Assignee: Enclos Corporation, Eagan, MN (US)

( * ) Notice: Subject to any disclaimer, the term of this patent is extended or adjusted under 35 U.S.C. 154(b) by 0 days.

(21) Appl. No.: 13/182,806

(22) Filed: Jul. 14, 2011

(65) Prior Publication Data

US 2011/0265404 A1 Nov. 3, 2011

Related U.S. Application Data

(63) Continuation of application No. 11/532,360, filed on Sep. 15, 2006, now Pat. No. 7,987,644.

(51) Int. Cl.
*E04B 1/00* (2006.01)

(52) U.S. Cl.
USPC ..... 52/741.4; 52/235; 52/202; 52/204.5; 52/204.59

(58) Field of Classification Search ..... 52/79.12, 52/202, 235, 238.1, 239, 741.3, 741.4, 742.12, 52/742.19
See application file for complete search history.

(56) References Cited

U.S. PATENT DOCUMENTS

| | | | | |
|---|---|---|---|---|
| 1,841,887 | A | | 1/1932 | Goldsmith et al. |
| 2,109,520 | A | | 3/1938 | Awbrey |
| 2,901,785 | A | | 9/1959 | Hinchliffe et al. |
| 2,914,145 | A | | 11/1959 | Benson |
| 3,176,806 | A | * | 4/1965 | Ferrell ..... 52/209 |
| 3,600,854 | A | | 8/1971 | Dallaire et al. |
| 3,715,848 | A | * | 2/1973 | Jordan ..... 52/235 |
| 3,771,276 | A | | 11/1973 | Stewart et al. |
| 3,858,375 | A | | 1/1975 | Silvernail |
| 3,936,986 | A | | 2/1976 | Steel |
| 3,968,608 | A | | 7/1976 | Swango |
| 3,990,201 | A | | 11/1976 | Falbel |
| 4,265,300 | A | | 5/1981 | Kurimoto |
| 4,267,673 | A | | 5/1981 | Coulston |
| 4,285,184 | A | | 8/1981 | Turner, Jr. |
| 4,453,855 | A | | 6/1984 | Richter et al. |
| 4,473,984 | A | | 10/1984 | Lopez |
| 4,506,595 | A | | 3/1985 | Roberts et al. |

(Continued)

FOREIGN PATENT DOCUMENTS

| | | |
|---|---|---|
| DE | 3401996 | 7/1984 |
| DE | 196 35 466 A1 | 3/1998 |

(Continued)

OTHER PUBLICATIONS

Halfen® Anchoring Systems, brochure for "Curtainwall Anchoring: Top of Slab Condition," Published at least as early as Jul. 14, 2011. 4 pages.

Technical Glass Products (TGP), data sheets for Curtainwall series 60/120 Minute Fire-rated Frame System Reference Elevation (Jul. 2003), 18 pages. www.fireglass.com.

Halfen® Anchoring Systems, brochure for "Curtainwall Anchoring: Top of Slab Condition," Published at least as early as Jul. 14, 2011, 4 pages.

(Continued)

*Primary Examiner* — William Gilbert
*Assistant Examiner* — Patrick Maestri
(74) *Attorney, Agent, or Firm* — Dorsey & Whitney LLP

(57) ABSTRACT

A modular curtainwall system and a method for forming a curtainwall unit are provided. The modular curtainwall system comprises a unit frame and a cassette. The cassette comprises a subframe and an interior portion. The stick unit frame and cassette may be assembled into a curtainwall unit at an offsite facility.

8 Claims, 11 Drawing Sheets

U.S. PATENT DOCUMENTS

| | | | | |
|---|---|---|---|---|
| 4,543,755 | A | | 10/1985 | Crandell |
| 4,546,582 | A | | 10/1985 | Gartner |
| 4,565,040 | A | | 1/1986 | Kaminaga |
| 4,633,631 | A | | 1/1987 | Crandell |
| 4,644,717 | A | | 2/1987 | Biebuyck |
| 4,658,559 | A | | 4/1987 | Doherty |
| 4,724,637 | A | | 2/1988 | Evans |
| 4,738,065 | A | | 4/1988 | Crandell |
| 4,831,799 | A | | 5/1989 | Glover et al. |
| 4,869,036 | A | | 9/1989 | Peacock |
| 4,873,805 | A | | 10/1989 | Ting |
| 4,879,842 | A | | 11/1989 | Bailey |
| 4,905,444 | A | | 3/1990 | Semaan et al. |
| 4,947,615 | A | | 8/1990 | Peacock |
| 4,951,438 | A | | 8/1990 | Thoresen |
| 4,952,430 | A | | 8/1990 | Bowser et al. |
| 5,063,718 | A | | 11/1991 | Nonis |
| 5,067,292 | A | | 11/1991 | Finean |
| 5,094,052 | A | * | 3/1992 | Gudmundsson et al. .... 52/238.1 |
| 5,156,894 | A | | 10/1992 | Hood et al. |
| 5,158,392 | A | | 10/1992 | Takeda |
| 5,197,255 | A | | 3/1993 | Fricker |
| 5,243,805 | A | | 9/1993 | Fricker |
| 5,253,459 | A | | 10/1993 | Parinas et al. |
| 5,267,419 | A | | 12/1993 | Yokota et al. |
| 5,355,645 | A | | 10/1994 | Farag |
| 5,381,637 | A | * | 1/1995 | Farag ..... 52/204.595 |
| 5,435,107 | A | | 7/1995 | Seibold |
| 5,481,839 | A | | 1/1996 | Lang et al. |
| 5,544,465 | A | | 8/1996 | Hood et al. |
| 5,548,939 | A | | 8/1996 | Carmical |
| 5,598,669 | A | | 2/1997 | Hamdi et al. |
| 5,601,677 | A | | 2/1997 | Leopold |
| 5,623,804 | A | | 4/1997 | Kelly et al. |
| 5,890,340 | A | | 4/1999 | Kafarowski |
| 5,937,597 | A | | 8/1999 | Sono et al. |
| 5,942,736 | A | | 8/1999 | Cortonesi |
| 5,992,111 | A | | 11/1999 | Waterhouse |
| 6,000,180 | A | * | 12/1999 | Goodman et al. ..... 52/239 |
| 6,032,423 | A | | 3/2000 | Takemura et al. |
| 6,056,037 | A | | 5/2000 | Jonkman, Sr. et al. |
| 6,345,485 | B1 | | 2/2002 | Boone et al. |
| 6,360,498 | B1 | | 3/2002 | Westphal |
| 6,581,354 | B1 | | 6/2003 | Skarpness |
| 6,591,562 | B2 | | 7/2003 | Ting |
| 6,598,361 | B2 | | 7/2003 | Ting |
| 6,612,091 | B1 | | 9/2003 | Glover et al. |
| 6,658,804 | B2 | | 12/2003 | Leytes et al. |
| 6,668,974 | B1 | | 12/2003 | Mottelet et al. |
| 6,670,011 | B2 | * | 12/2003 | Weinstein et al. ..... 428/43 |
| 6,715,248 | B2 | | 4/2004 | Biebuyck |
| 6,722,089 | B2 | | 4/2004 | Budzinski |
| 6,749,363 | B1 | | 6/2004 | Petersen |
| 6,935,077 | B2 | | 8/2005 | Wulfert et al. |
| 7,104,015 | B2 | | 9/2006 | Huynh |
| 7,134,247 | B2 | | 11/2006 | Ting |
| 7,146,769 | B1 | * | 12/2006 | Culverson ..... 52/204.5 |
| 7,281,561 | B2 | | 10/2007 | Anderson et al. |
| 7,393,271 | B2 | | 7/2008 | Green |
| 7,516,583 | B2 | | 4/2009 | Mitchell |
| 7,588,653 | B2 | | 9/2009 | Crandell et al. |
| 7,637,063 | B2 | | 12/2009 | Sensini |
| 7,681,366 | B2 | | 3/2010 | De Gobbi |
| 2004/0168382 | A1 | | 9/2004 | Rudduck et al. |
| 2005/0235581 | A1 | | 10/2005 | Cohen et al. |
| 2006/0059801 | A1 | | 3/2006 | Allaei |
| 2006/0080902 | A1 | | 4/2006 | Bren |
| 2007/0022682 | A1 | | 2/2007 | Morgenegg et al. |
| 2009/0008185 | A1 | | 1/2009 | Cheng et al. |
| 2009/0311449 | A1 | | 12/2009 | Fehlmann et al. |
| 2010/0009619 | A1 | | 1/2010 | Christensen et al. |
| 2010/0281797 | A1 | | 11/2010 | Yun |

FOREIGN PATENT DOCUMENTS

| | | |
|---|---|---|
| EP | 0819817 | 1/1998 |
| FR | 2907490 | 4/2008 |
| JP | 2003063844 | 3/2003 |
| JP | 2004210553 | 7/2004 |
| JP | 2004324268 | 11/2004 |
| JP | 2005104764 | 4/2005 |
| JP | 2008024546 | 2/2008 |
| JP | 2008115078 | 5/2008 |
| JP | 2008266062 | 11/2008 |
| WO | WO 01/25581 | 4/2001 |

OTHER PUBLICATIONS

Gosselin et al. "A computational method for calculating heat transfer and airflow through a dual-airflow window" *Energy and Buildings*. 2008. 40(4) 452-458.

Halfen® Anchoring Systems, brochure for "Curtainwall Anchoring: Top of Slab Condition," Published at least as early as Jul. 14, 2011, 8 pages.

Wausau Window and Wall Systems, data sheet for Curtainwall, 7250-UW Series, (2004), 1 page.

Halfen® Anchoring Systems, data sheet for Curtain Wall Anchors, 1 page, Published at least as early as Jul. 14, 2011.

Halfen® Anchoring Systems, data sheet for Halfen Multi-Adjustable Curtain Wall Clips, 1 page, Published at least as early as Jul. 14, 2011.

Halfen® Anchoring Systems, data sheet for Hi-Tensile Inserts, 1 page, 1998.

Quirouette, R.C. "Building Science Insight: Glass and Metal Curtain Wall Systems". Reprinted version of Building Practice Note No. 37, entitled "Building Envelope Design Using Metal and Glass Curtain Wall Systems" presented at the 1982 Building Science Forum. National Research Council Canada. Retrieved from http://irc.nrc-cnrc.gc.ca/bsi/82-3_E.html on Jul. 28, 2005, 15 pages.

Traco Architectural Systems, Inc. Diagrams for Project Name TR-7802, 2 pages, Jun. 12, 2002.

Traco Architectural Systems, Inc. data sheet for Curtain Wall System (Outside Glazed) Diagrams for Project Name TR-7801-3, 1 page, Nov. 2002.

Kawneer Company, Inc., data sheet for Sealair® Architectural Windows: Series 7225 and 8225T-L Installation and Anchoring Typical Installation Details, (1994), 4 pages.

Technical Glass Products (TGP), data sheets for Curtainwall series 60/120 Minute Fire-rated Frame System Reference Elevation (Jul. 2003), 18 pages, www.fireglass.com.

Texas Wall Systems, Inc., Product profiles for: 04 Stool Horizontal; 06 Sill Horizontal; 12 Sill Horizontal; 04 Sill Horizontal; and 06 Sill Horizontal (Retrieved from http://www.texaswall.com on May 21, 2005), 5 pages total.

Halfen® Anchoring Systems, data sheet for Strip Window to Precast Panel Connection (1998), 1 page.

Halfen® Anchoring Systems, data sheet for Punched or Strip Windows Anchors in Architectural Precast Panels (1998), 1 page.

Halfen® Anchoring Systems, data sheet for Double Tee Connection to Ledger Beam (1998), 1 page.

Halfen® Anchoring Systems, data sheet for Double Tee Connection to Shear Wall or Column (1998), 1 page.

Halfen® Anchoring Systems, data sheet for Access Ladder Connection for Precast Utility Units (1998), 1 page.

Halfen® Anchoring Systems, data sheet for Halfen Anchors at Joints of Precast Sewer Chimneys and Wet Wells (1998), 1 page.

Halfen® Anchoring Systems, data sheet for Expansion Joint Anchoring Detail (1998), 1 page.

American Architectural Manufacturers Association, "Aluminum Curtain Wall Design Guide Manual," p. 122-125 (1979).

Enclos Corporation, blueprints for Astor Place, drawings showing horizontal details of vision sill starter (Drawn Mar. 4 2004), 1 sheet.

Enclos Corporation, blueprints for Astor Place, drawings showing spandrel stack head sections/shearwall section (Drawn Mar. 3, 2004), 1 sheet.

Enclos Corporation, blueprints for Astor Place, drawings showing louver vertical details/anchor at louvers and anchor at louvers/spandrel (Drawn Mar. 5, 2004), 1 sheet.

Enclos Corporation, blueprints for Astor Place, drawings showing louver corner anchor details/OS corner at louver (Drawn Mar. 12, 2004), 1 sheet.

* cited by examiner

CURTAINWALL SYSTEM

CROSS-REFERENCE TO RELATED APPLICATIONS

This application is a continuation of application Ser. No. 11/532,360, filed on Sep. 15, 2006 now U.S. Pat. No. 7,987,644, the entire contents of which are incorporated herein by reference.

FIELD OF THE INVENTION

The present invention relates to a curtainwall system. More specifically, the present invention relates to a modular curtainwall system.

BACKGROUND OF THE INVENTION

Construction technology often employs unitized curtainwall units that are anchored to the building structure. A curtainwall system is a lightweight exterior cladding that is connected to the building structure, usually from floor to floor. It can provide a variety of exterior appearances. Curtainwalls are designed to accommodate structural deflections, control wind-driven rain and air leakage, minimize the effects of solar radiation, and provide for low maintenance long term performance.

The curtainwall is an external, lightweight, generally nonloadbearing wall that is hung from a frame rather than built up from the ground. The framework it shields, and to which the curtainwall is connected, usually is made of concrete or steel. Curtainwalls may be used with any suitable structure but are typically used in high-rise buildings. Typically light, the use of curtainwalls reduces the forces on the foundations, making the building lighter. Curtainwalls may be a form of prefabricated construction, and can be installed with relative ease, even at significant heights above the ground.

Curtainwalls may be produced in a fully ready-to-install form, in which case they may be installed as discrete building units (curtainwall units). The ready-to-install form is referred to as a unitized system. The unitized system is costly to ship due to its large size and heavy weight. Furthermore, typically only a limited number of units can be packed into each shipping container. To minimize the problems associated with shipping, unitized systems may be manufactured to a point less than complete at a manufacturer's location and then shipped to an assembly facility where they are completed. The assembly facility may be located generally proximate to the installation site. Any component parts are wet sealed to form a unit at the assembly facility. Wet sealing typically comprises laying the unit flat, sealing, clamping, and maintaining the unit in position for first and second cure times. The first cure time is generally approximately one hour during which no movement of the unit is permitted. Because the units are laid flat during wet sealing and cannot be moved at all during at least the first cure time, the assembly facility typically must have relatively large square footage. Further, because the assembly facility is generally located proximate the installation site, the labor hired for the facility is typically new for each building. This can lead to concerns regarding quality assurance and quality control (QA/QC).

Another type of curtainwall system is a stick system. In a stick system, each component part of a curtainwall is shipped to the installation site and the curtainwall is built up at the installation site. Thus, a stick system is labor intensive at the installation site. The construction site also presents a more challenging environment for QA/QC including but, not limited to, application of wet sealants at the construction site.

It would be desirable to provide a system that allows for partial assembly of components, including application of wet sealant, at a low cost facility with high quality control standards and then final assembly of the complete curtainwall unit at a small facility close to the construction site or at a dedicated area of the construction site itself, in either case without the need for application of wet sealant. In addition to better quality control, this would allow for higher through put and minimal space needs at the final assembly location.

BRIEF SUMMARY OF THE INVENTION

A modular curtainwall system and a method for forming a curtainwall unit are provided.

In one embodiment, the modular curtainwall system comprises a unit frame and an in-fill cassette. The in-fill cassette comprises an interior portion and a subframe. The in-fill cassette is configured to be inserted into the unit frame at an offsite facility to form a curtainwall unit.

In one embodiment, the method comprises providing a unit frame and an in-fill cassette at an offsite facility. The in-fill cassette comprises a subframe and an interior portion. The method further comprises installing the in-fill cassette in the unit frame at the offsite facility.

While multiple embodiments are disclosed, still other embodiments of the present invention will become apparent to those skilled in the art from the following detailed description, which shows and describes illustrative embodiments of the invention. As will be realized, the invention is capable of modifications in various aspects, all without departing from the spirit and scope of the present invention. Accordingly, the drawings and detailed description are to be regarded as illustrative in nature and not restrictive.

DETAILED DESCRIPTION OF THE INVENTION

Figure 1:
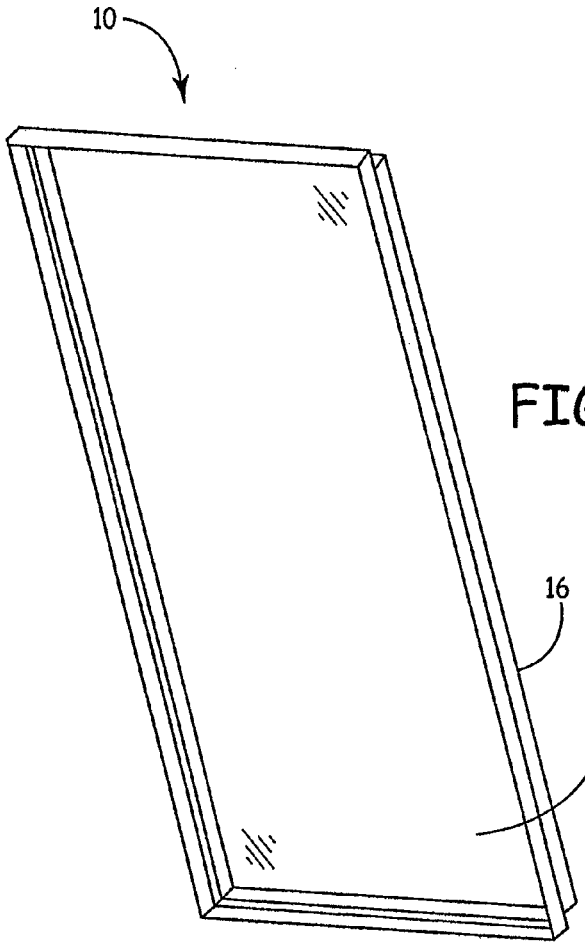
FIG. 1 illustrates an in-fill cassette in accordance with one embodiment of the invention.

A modular curtainwall system is provided. The curtainwall system includes a unit frame 14 (see, for example, FIG. 5) and a cassette 10, 12 (see, for example, FIGS. 1, 2, and 3). The cassette 10, 12 is a modular component that can be easily inserted into the unit frame 14 to form a curtainwall unit.

The cassette 10, 12 includes a subframe 16 and an interior portion 17. The subframe 16 is the portion of the cassette 10, 12 extending along the periphery of the cassette 10, 12. The subframe 16 may be metal or other suitable material for framing the interior portion 17 and being received by the unit frame 14. The interior portion 17 is the portion of the cassette 10, 12 that is located within the subframe 16. In some embodiments, more than one interior portion 17 may be provided. For example, two layers of interior portion may be provided, one facing towards the interior of the building as constructed and one facing towards the exterior of the building as constructed. The interior portion 17 is sealed to the subframe 16, for example using an adhesive, tape, wet sealant, dry gasket, or other suitable sealant.

Generally, at least two types of cassettes may be provided: in-fill cassettes 10 and secondary cassettes 12. In-fill cassettes 10 have an interior portion 17 that is viewable from the exterior of the building when constructed. Secondary cassettes 12 have an interior portion 17 that cannot be viewed from the exterior of the building when constructed. Conceptually, the in-fill cassette 10 is the portion most seen on the building when a viewer is looking at the outside of the building after construction.

Figure 2:
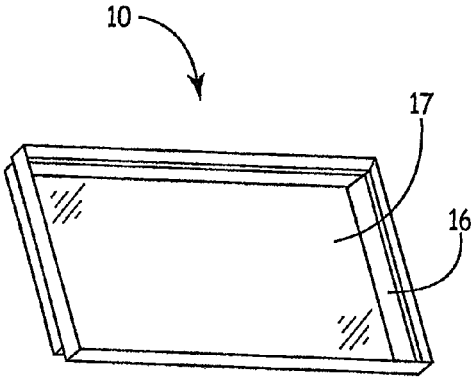
FIG. 2 illustrates an in-fill cassette in accordance with another embodiment of the invention.

FIGS. 1 and 2 illustrate in-fill cassettes. In-fill cassettes 10 may have interior portions 17 comprising glass, glass with operable mini-blinds, stone, metal panels, composite panels, treated wood panels, simulated wood panels, louvers, bird screens, shadow-box components (comprising glass, metal panels, etc.), metal extrusions, photovoltaic panels, perforated metal panels, electronic video screens, or other for forming a viewable cassette.

Figure 9:
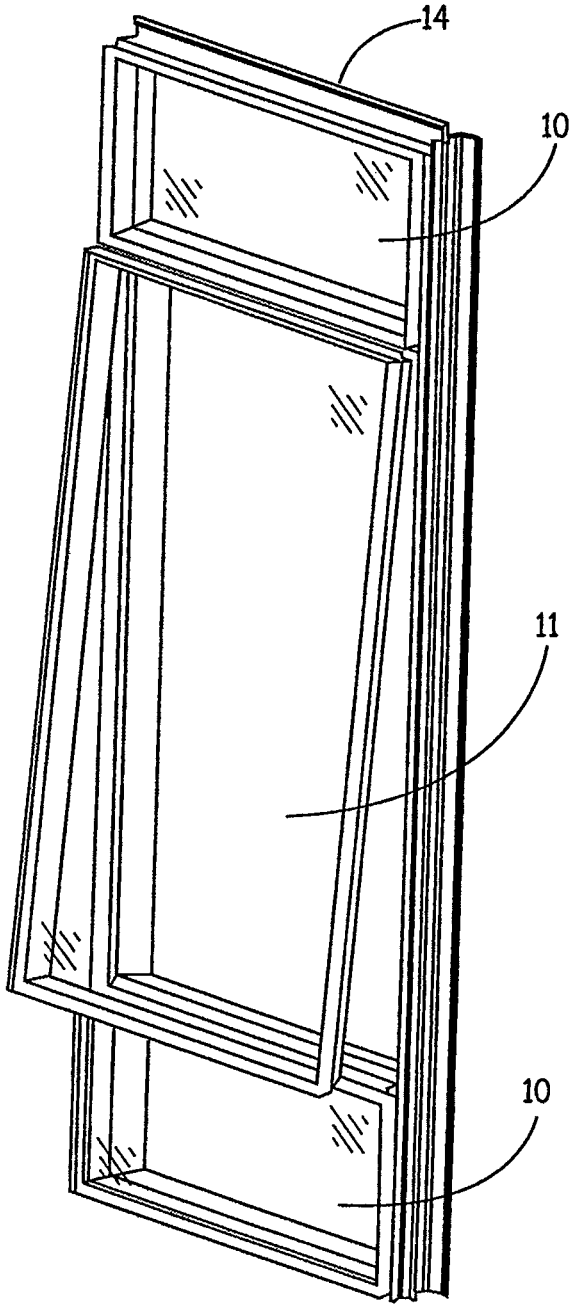
FIG. 9 illustrates an assembled curtainwall unit having a large operable in-fill cassette in accordance with one embodiment of the invention.
Figure 10:
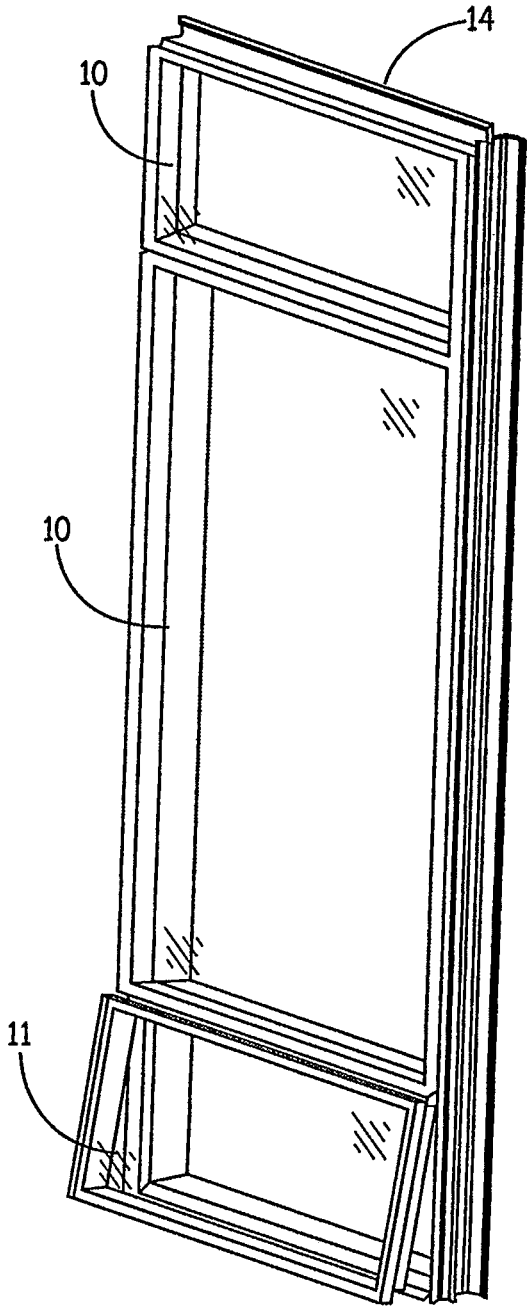
FIG. 10 illustrates an assembled curtainwall unit having a small operable in-fill cassette in accordance with one embodiment of the invention.

In-fill cassettes 10 may be operable or fixed. Fixed cassettes cannot be opened whereas operable cassettes can be opened. FIGS. 9 and 10 show a curtainwall unit comprising a unit frame 14 and three in-fill cassettes 10, 11 wherein at least one of the in-fill cassettes is an operable cassette 11. In the past, a gasket is apparent only on curtainwall units having operable portions such as operable windows. Thus, architects needed to review aesthetic considerations as well as practical considerations in deciding where to put operable portions. Further, once the decision was made to place an operable portion or a fixed portion, it was relatively difficult to change that decision as the aesthetics of the building would be changed. Using the modular curtainwall system, operable in-fill cassettes and fixed in-fill cassettes appear substantially the same. This makes the decision-making process of where to place operable in-fill cassettes easier insofar as aesthetic considerations need not be reviewed. Further, it makes it easier to change a plan from an operable in-fill cassette to a fixed in-fill cassette, or vice versa, as aesthetics of the building will not be altered.

In one embodiment, an operable glass in-fill cassette 11 is provided for forming an operable window that opens. Generally, in manufacturing the cassette, the top of the interior portion is hinged to the subframe. The interior portion is thus permitted to pivot within the subframe. To provide an operable cassette, the sides and bottom of the interior portion are not permanently sealed to the subframe.

Figure 3:
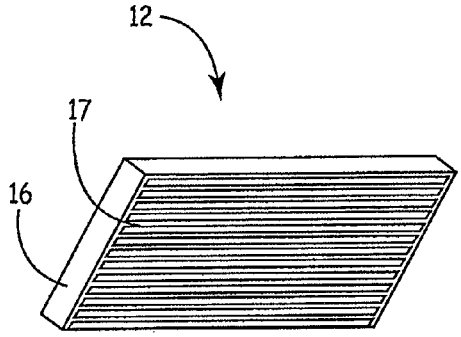
FIG. 3 illustrates an insulation secondary cassette in accordance with one embodiment of the invention.

FIG. 3 illustrates a secondary cassette. Secondary cassettes 12 may generally be thermal cassettes, vision enhancement cassettes, acoustic cassettes, combinations thereof, or other. Thus, for example, thermal secondary cassettes may have insulation interior portions. Vision enhancement secondary cassettes may have shadow box (e.g. glass, metal panels, painted panels, mirrors, etc.), wood panels, wall coverings (paper, vinyl, etc.) on a substrate, metal extrusions, etc. interior portions. Acoustic secondary cassettes may have drywall or other acoustic performance enhancement material interior portions. Any of the secondary cassettes may also include vapor barrier sheets.

In some embodiments, a cassette may include an in-fill interior and a secondary interior. For example, one side of the cassette may have in-fill glass and the other side of the cassette may have insulation.

The interior portion 17 of the cassette 10, 12 is inserted and sealed into the subframe 16 at a manufacturing facility, prior to shipment to the assembly facility. Sealing of the interior portion into the subframe may be done using any suitable sealant. For example, the sealant may be a wet sealant. In such embodiment, the wet sealing is thus done at the manufacturer.

Figure 4:
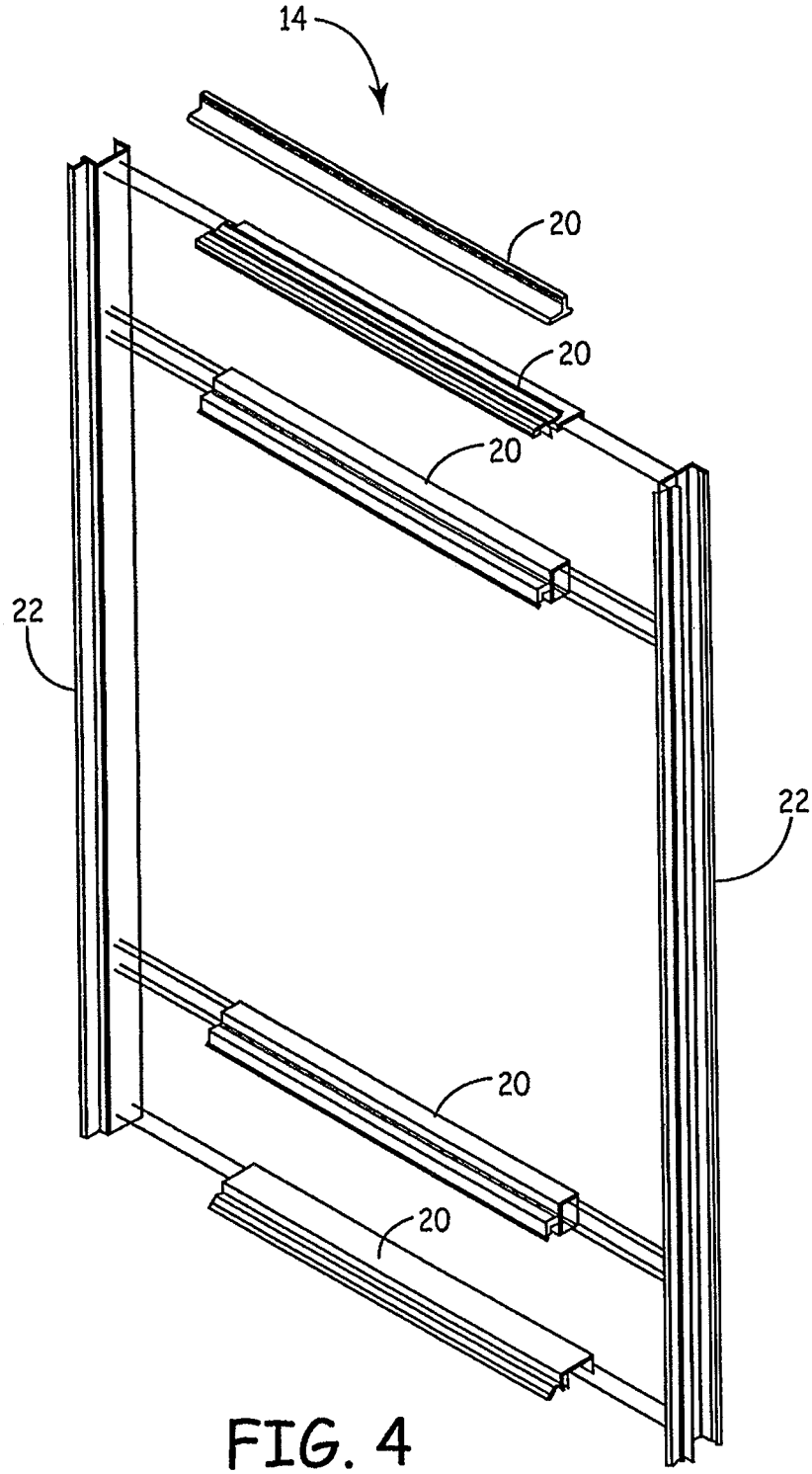
FIG. 4 illustrates an exploded view of a unit frame in accordance with one embodiment of the invention.
Figure 5:
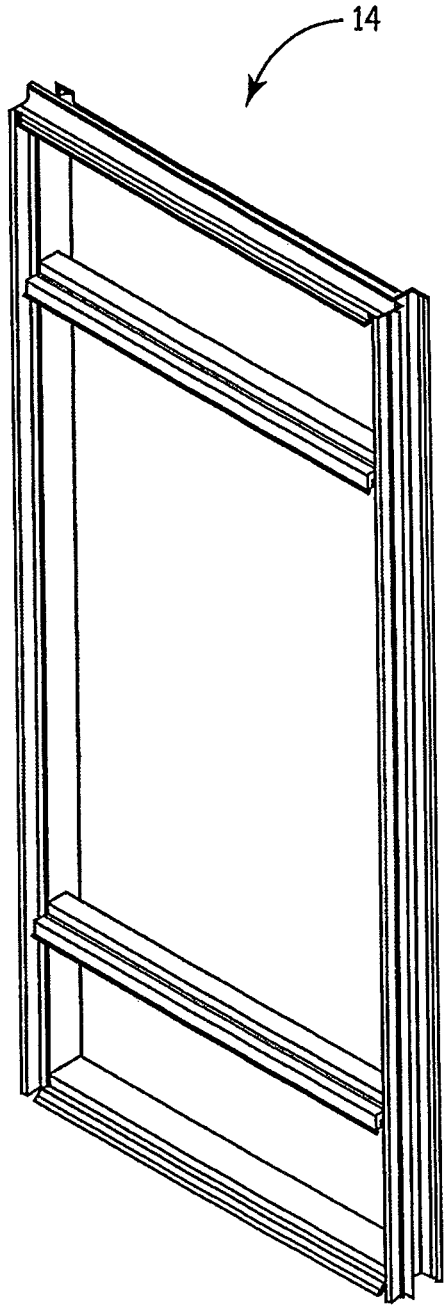
FIG. 5 illustrates an assembled unit frame in accordance with one embodiment of the invention.

FIGS. 4 and 5 illustrate the unit frame 14. The unit frame 14 may be assembled by a manufacturer and shipped to an assembly facility or may be shipped to an assembly facility as pieces or sticks 20, 22 (see FIG. 4). These pieces 20, 22 are assembled into the unit frame 14, for example by using screws, adding a dry gasket or other, etc.

Terminology—occasionally people refer to the metal mullions that are the aluminum sticks that form the assembly. This is confusing with the stick assembly process. Enclos refers to sticks as mullions. Thus, in some embodiments, the unit frame 14 may be provided as a mullion assembly, wherein the components 20, 22 of the mullion assembly are assembled into the frame. Generally, vertically extending components or mullions 22 and horizontally extending components or sticks 20 are provided. Each of the mullions 20, 22 may be provided with padding comprising a sealant. The padding may be provided along only a portion of the mullion, for example, at a corner of the mullion for joining to another mullion. The padding may be applied over any portion or on the entirety of the mullions, as suitable for the given application. The padding may be applied to the mullions in any suitable manner. For example, an adhesive backing may be applied on the padding and the padding applied to the mullion via the adhesive backing. When assembling the mullions into a unit frame, the portions of the mullions having padding applied thereto may be pressed together, or attached in any suitable manner, with the padding therebetween. Any suitable padding material may be used. For example, the padding may comprise foam, PVC, silicone sheeting, silicone impregnated open cell foam, or wet sealant. In one embodiment, this material may easily be torn such that excess of the padding between the mullions may be torn and removed.

Figure 6:
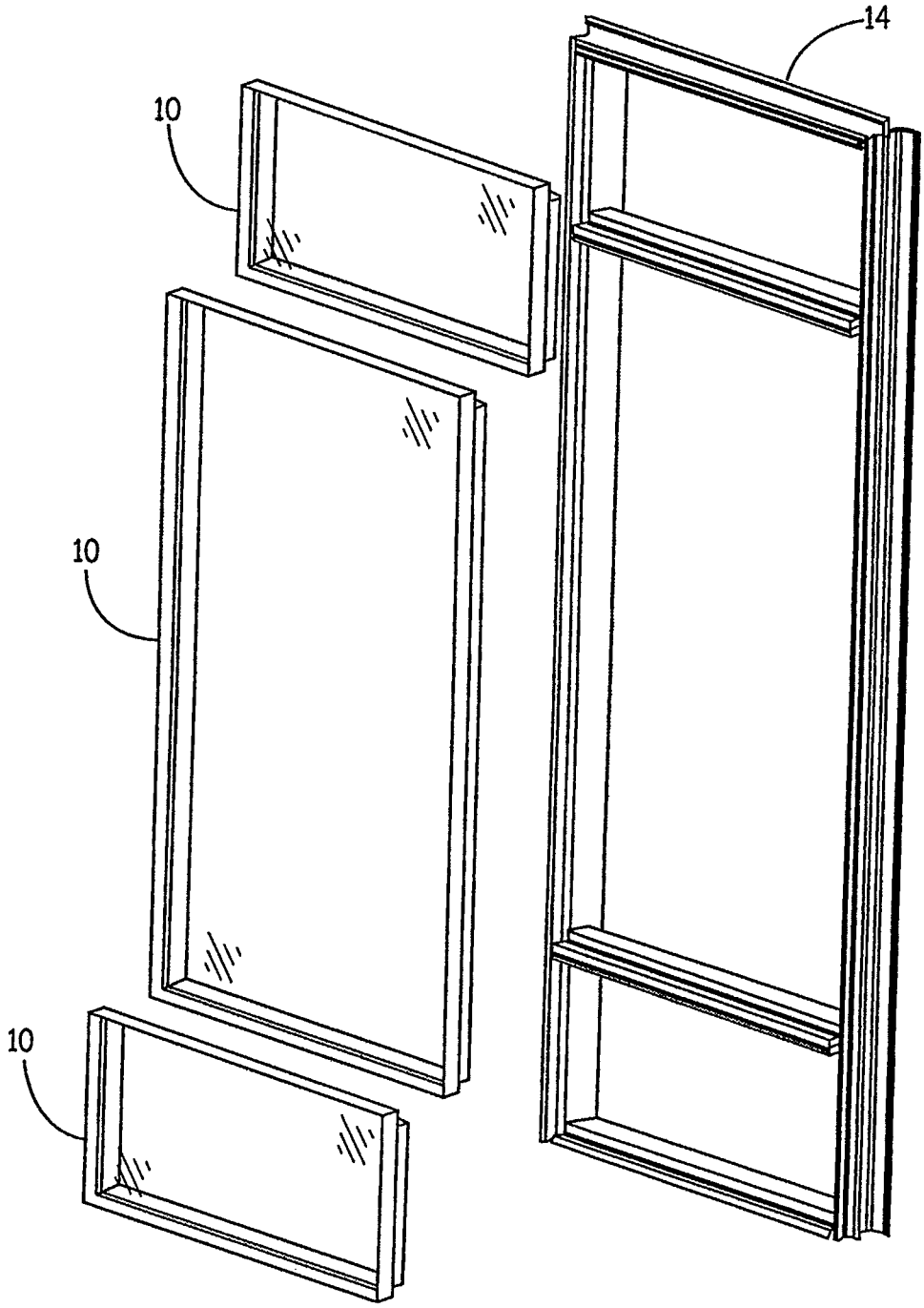
FIG. 6 illustrates an exploded view of a unit frame and three in-fill cassettes in accordance with one embodiment of the invention.
Figure 7:
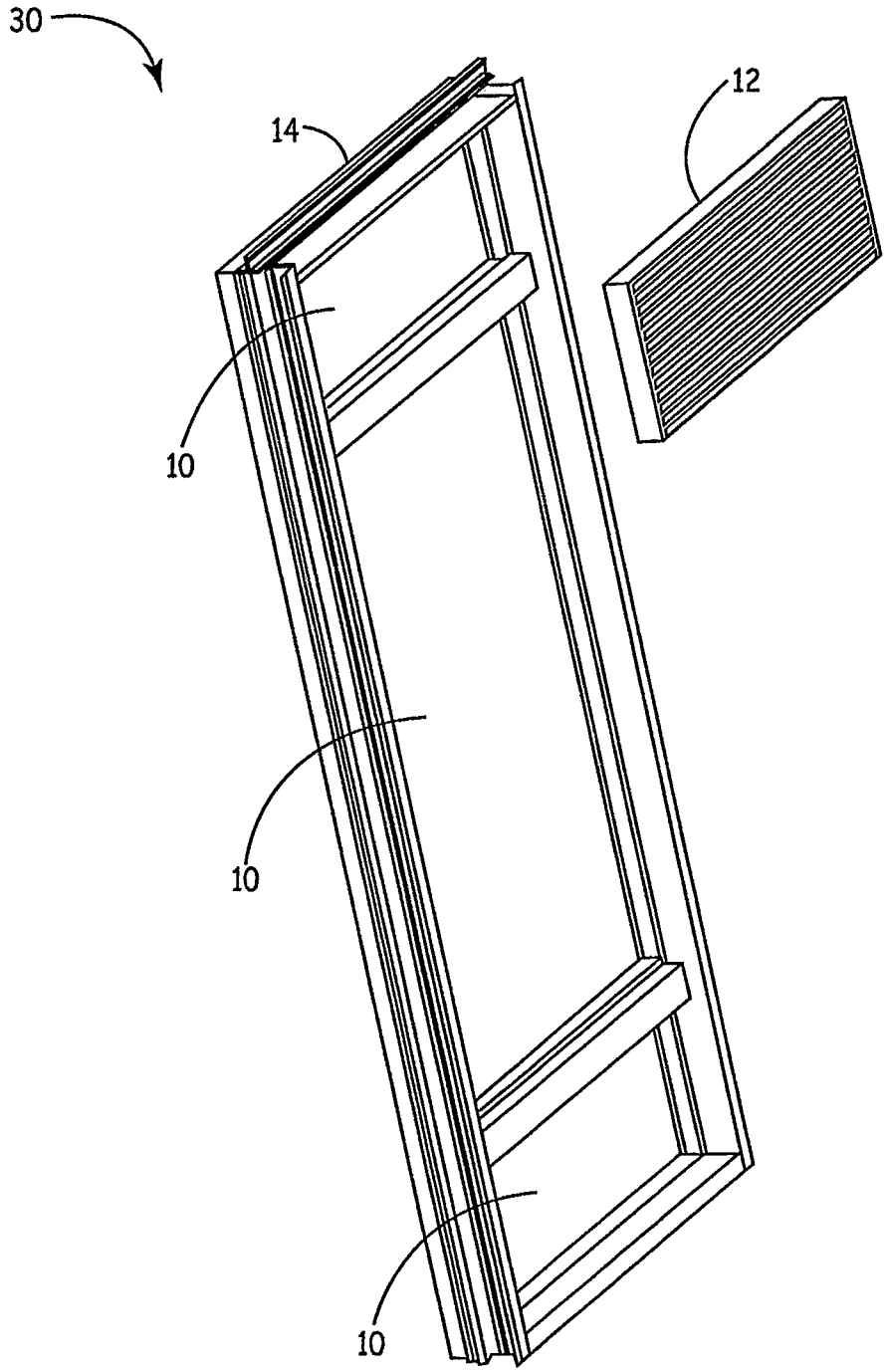
FIG. 7 illustrates an exploded view of a unit frame having three in-fill cassettes placed therein and a secondary cassette in accordance with one embodiment of the invention.
Figure 8:
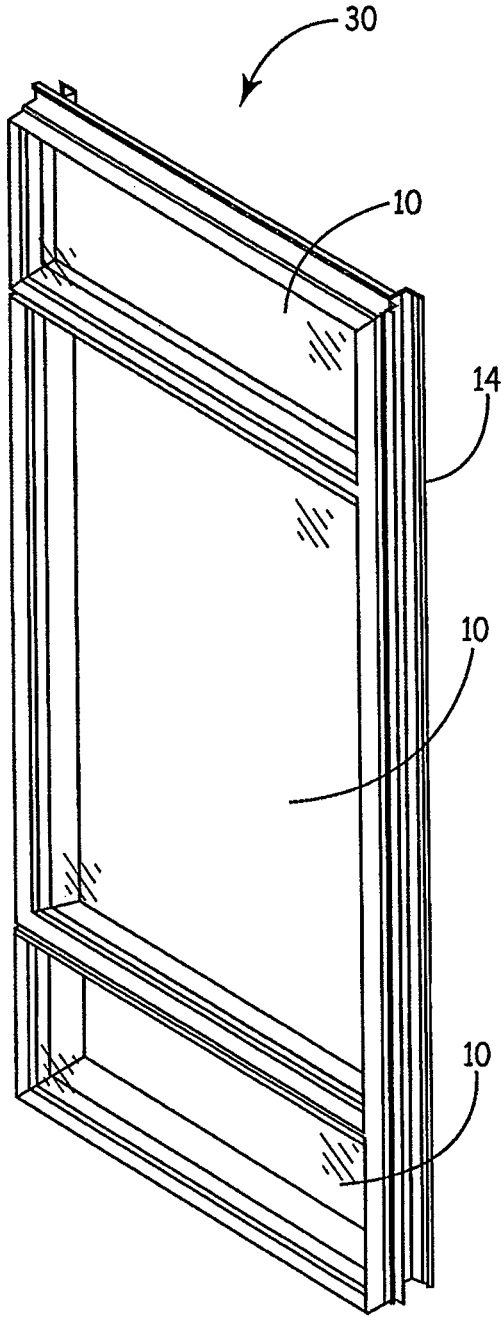
FIG. 8 illustrates an assembled curtainwall unit in accordance with one embodiment of the invention.

Thus, components for forming the unit, including the unit frame 14 (either the assembled unit frame or mullions 20, 22 for forming the unit frame) and the cassette 10, 12 are assembled by a manufacturer (or by several manufacturers) and shipped to an assembly facility. At the assembly facility, the unit frame 14 may be assembled (if shipped unassembled) and the cassettes 10, 12 inserted therein. This is a final light assembly requiring little equipment and space wherein no wet sealant need be applied. In alternative embodiments, final assembly may be done onsite at the installation site. FIG. 6 illustrates a unit frame 14 and in-fill cassettes 10 for insertion in the unit frame 14. FIG. 7 illustrates a unit frame 14 having in-fill cassettes 10 inserted therein and a secondary cassette 12 for insertion in the unit frame 14. FIG. 8 illustrates an assembled curtainwall unit 30. The assembly facility may be a designated area of the construction site such that the curtainwall unit is formed from the modular pieces at the construction site.

In one embodiment, a primary seal is applied to the unit frame 14 to seal the cassette 10, 12 to the frame and a secondary seal is applied to the cassette 10, 12 for waterproofing. Compression may be applied to the primary seal when a male to female mullion connection is formed. A further seal may be provided between adjacent curtainwall units 30, each curtainwall unit comprising the unit frame 14 and cassette(s) 10, 12. Each of these seals may be provided in any suitable manner. In one embodiment, each seal comprises a gasket. In another embodiment, each seal comprises a coextruded seal. In various embodiments, the seals may comprise the same type of seal or may comprise different types of seals.

The modular curtainwall system is assembled into a curtainwall unit 30 at an offsite assembly facility or designated area of the construction site. A sealant may be applied to the unit frame 14, and the cassette 10, 12 is placed in the subframe 14. Any suitable sealant may be used. Examples of suitable sealants include silicone, a dry gasket, or a wet sealant. In one embodiments, a dry gasket is used to seal the insert in the subframe such that no curing time is required. Fasteners may be used to fasten the cassette 10, 12 to the unit frame 14.

An insulation secondary cassette 12 may be easily be installed in the unit frame 14 at the offsite facility. In prior art curtainwall systems, installing insulation was a relatively labor intensive process—requiring the use of corner pieces around insulation, etc. Using the modular curtainwall unit, an insulation secondary cassette 12 is placed in the unit frame 14. Other components, such as aesthetic aluminum for shadow box through glass, may be added, as desired. The components may be combined in any suitable manner. For example, an in-fill cassette 10 may be provided layered over the insulation secondary cassette 12 in the unit frame 14 such that the in-fill cassette 10 forms the exterior of the curtainwall unit 30 and the insulation secondary cassette 12 forms the interior of the curtainwall unit 30. Further, layers may be provided within the secondary cassette 12 such as a layer of insulation and a layer of drywall, the drywall facing toward the interior of the building when the building is constructed.

Figure 11:
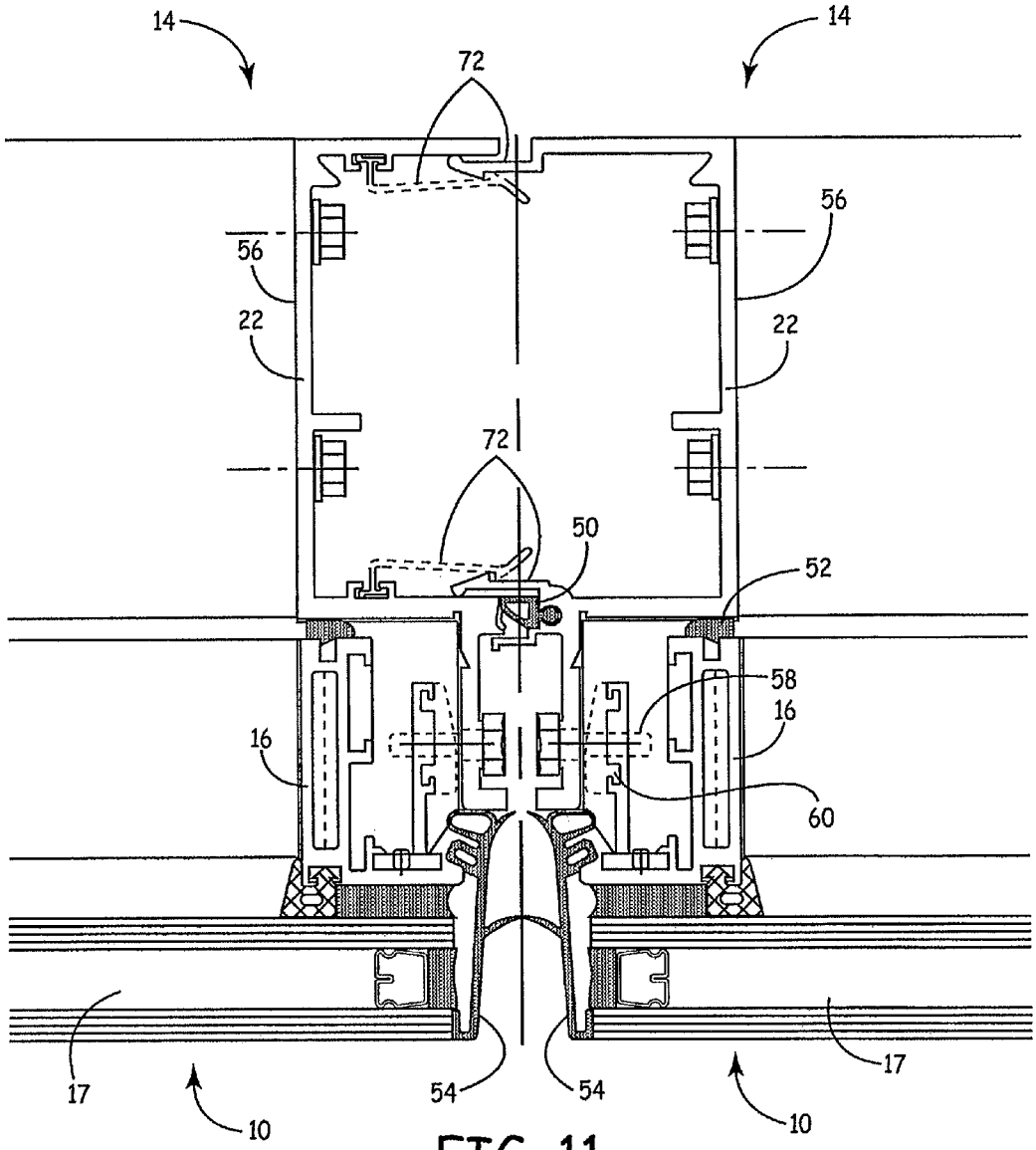
FIG. 11 shows a top cross-sectional view of the intersection of adjacent unit frames, according to certain embodiments.

Referring now to FIG. 11, a top view of the intersection of adjacent unit frames 14 is shown. Each unit frame 14 includes a vertical mullion 22 secured to the corresponding mullion 22 of the adjacent unit frame 14 via unit frame components 72. A fixed in-fill cassette 10 with a subframe 16 and a glass interior portion 17 is shown inserted in each unit frame 14. A primary seal 50 is shown between the unit frames 14 and a roll-in silicone gasket with molded corners 52 is shown for use with fixed cassettes 10. Additionally, a silicone gasket 54 is shown around the perimeter of each cassette 10, which functions as a secondary seal and glass edge protection. Padding 56 is also shown on the surface of the mullion 22 to accommodate adjoining mullions 20. A fixed cassette keyhole retainer 58 is shown extending through a portion of the unit frame 14 and into the subframe 16 of the cassette 10. A rigid CPVC extrusion 2" long spacer 60 is shown between key slots.

Figure 12:
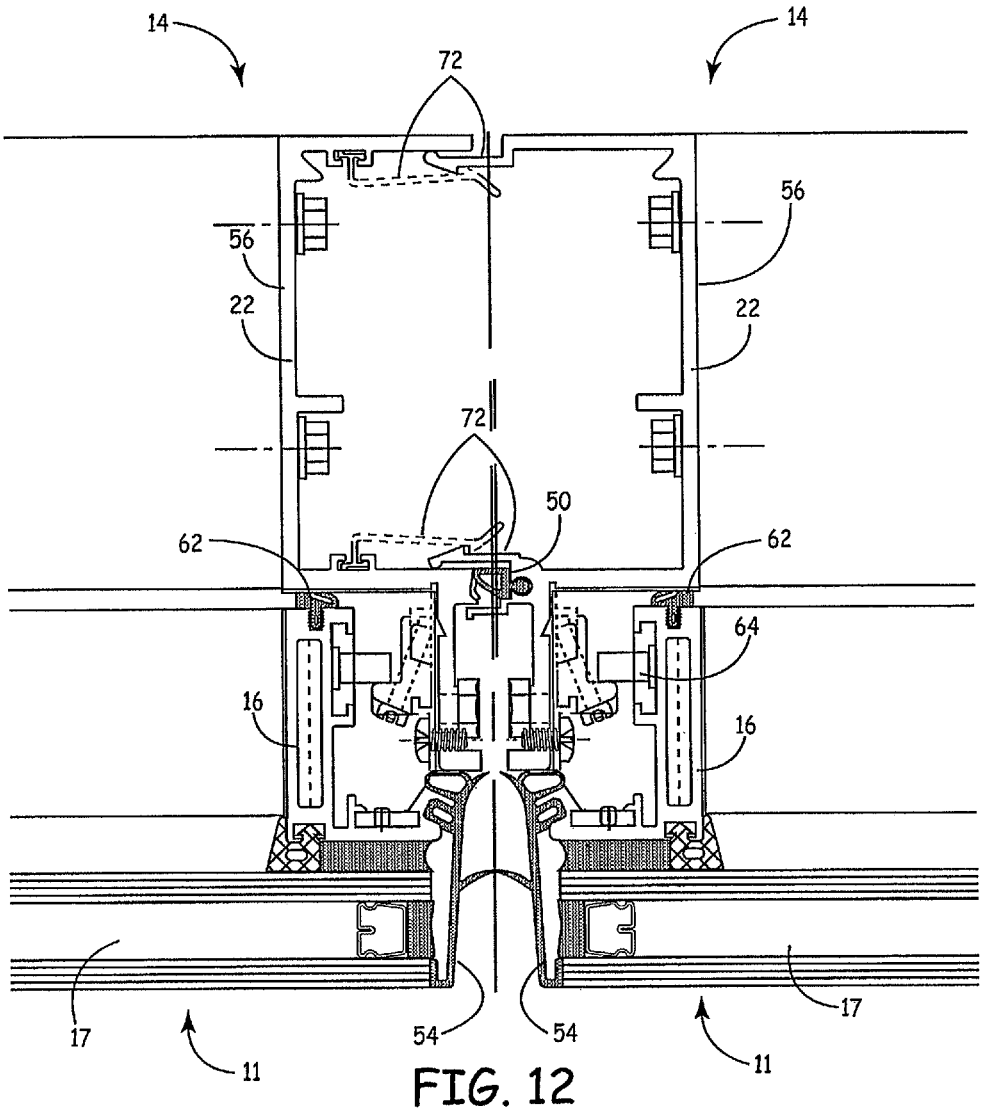
FIG. 12 shows a top cross-sectional view of the intersection of adjacent unit frames, according to certain embodiments.

Referring now to FIG. 12, a top view of the intersection of adjacent unit frames 14 is shown. Each unit frame 14 includes a vertical mullion 22 secured to the corresponding mullion 22 of the adjacent unit frame 14 via unit frame components 72. A horizontally operable in-fill cassette 11 with a subframe 16 and a glass interior portion 17 is shown inserted in each unit frame 14. A primary seal 50 is shown between the unit frames 14 and a gasket 62 is shown for use with operable cassettes 11. Additionally, a silicone gasket 54 is shown around the perimeter of each cassette 11, which functions as a secondary seal and glass edge protection. Padding 56 is also shown on the surface of the mullion 22 to accommodate adjoining mullions 20. A multi-point lock system 64 is shown for selectively securing the operable cassette 11 in a closed position.

Figure 13:
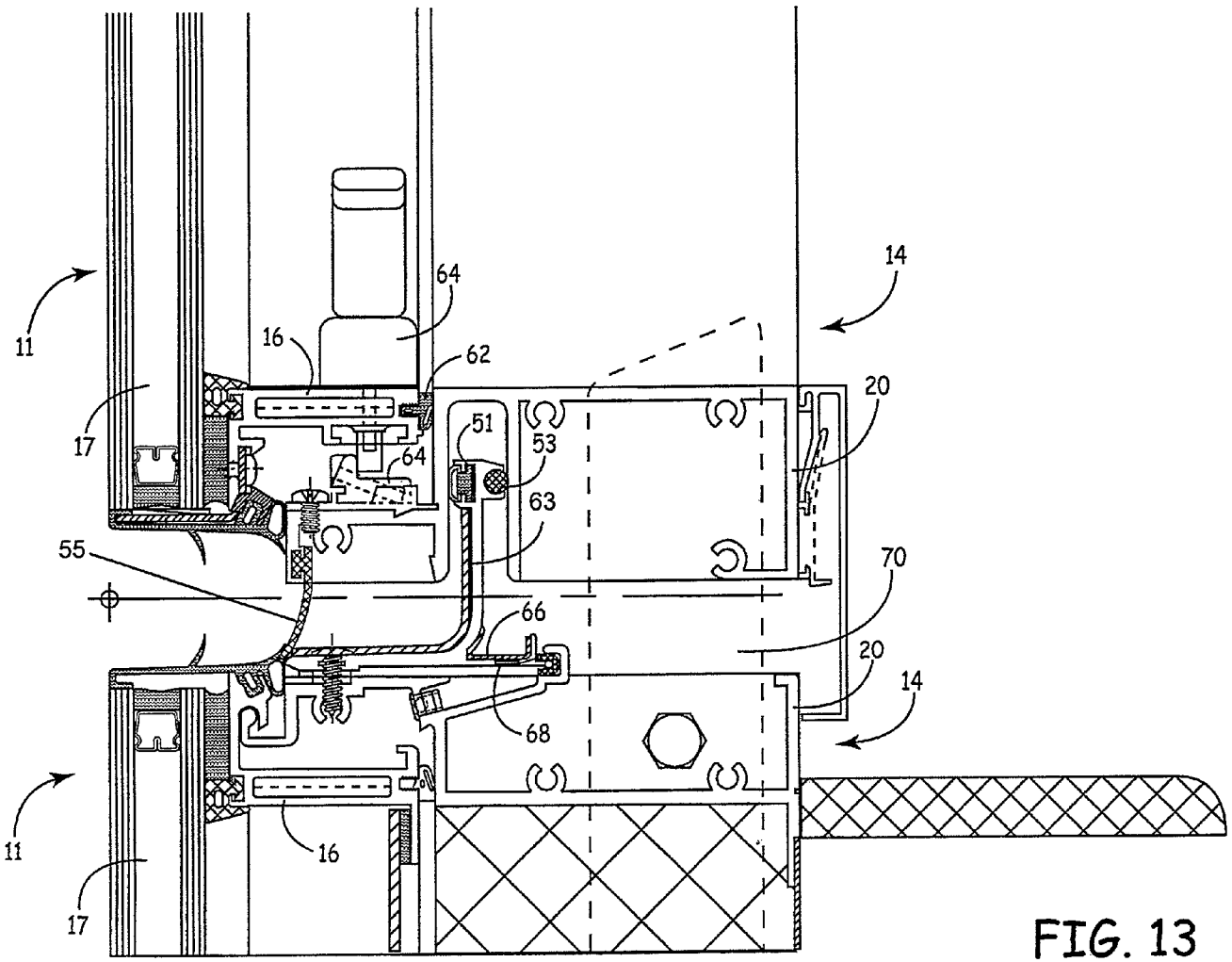
FIG. 13 shows a side cross-sectional view of a stack joint of adjacent unit frames, according to certain embodiments.

Referring now to FIG. 13, a side view of a stack joint of adjacent unit frames 14 is shown. Each unit frame 14 includes a horizontal mullion 20 positioned adjacent to the corresponding mullion 20 of the adjacent unit frame 14. A vertically operable in-fill cassette 11, similar to that depicted in FIGS. 9 and 10, is shown inserted in each unit frame 14. Each in-fill cassette 11 shown includes a subframe 16 and a glass interior portion 17. A continuous primary silicone seal gasket 51 is shown and an extruded rigid PVC roller round 53 is also shown. A field applied silicone sheet splice boot 63 is also shown as is a continuous secondary silicone seal gasket 55. The surgical silicone sheet splice boot 63 may be 0.040" thick by 2" wide. The stack joint also shows silicone extrusion 66 set in silicone for bridging a ¼" gutter joint. The silicone extrusion 66 may be a 90 Duro silicone extrusion. A backup gutter 68 may also be included and may be weeped to the outside via a jamb pocket. A one-way ball check may also be included. A structural splice sleeve 70 may also be provided at the stack joints. Similar to the horizontal operable in-fill cassette 11 of FIG. 12, the cassette 11 shown may include a gasket 62 for use with operable cassettes 11. A multi-point lock system 64 may also be included. The multi-point lock system 64 for the in-fill cassette 11 in either operable orientation may be a Sobinco brand system. In other embodiments, the lock may be another lock mechanism and may be selected from several known lock mechanisms known in the art and adapted to lock windows or other vents.

With the modular curtain wall system, a relatively large number of systems may be shipped to a suitable site, whether an assembly center, installation site, or designated area of the construction site. Wet sealant need not be used at the time of final assembly or installation at site In prior art systems, Because the silicone needed to cure and the units were laid flat during curing, through put was constrained by space. With the modular system, space does not constrain through put. Each curtainwall unit is easily assembled with minimal man power and reduced warehouse space is necessary because there is no longer a need to temporarily store the units during a cure time.

Although the present invention has been described with reference to preferred embodiments, persons skilled in the art will recognize that changes may be made in form and detail without departing from the spirit and scope of the invention.

What is claimed is:

1. A method of constructing a curtainwall for installation on a building, the curtainwall comprising a unit frame having a first side and a second side, the method comprising:

installing an in-fill cassette in the first side of the unit frame, the in-fill cassette comprising an in-fill cassette subframe and a first interior portion at least partially sealed to the subframe, the subframe defining a perimeter of the in-fill cassette and having a surface configured for sealing engagement with the first side of the unit frame substantially continuously along the perimeter; and installing a secondary cassette in the second side of the unit frame, the secondary cassette comprising a secondary cassette subframe and a secondary cassette interior portion at least partially sealed to the subframe, the subframe defining a perimeter of the secondary cassette and having a surface for sealing engagement with the second side of the unit frame substantially continuously along the perimeter, wherein the cassettes are fixed, and a portion of each edge of the perimeter of each cassette contacts a portion of the unit frame, wherein one of the in-fill cassette first interior portion and the secondary cassette interior portion comprises a shadow box component configured to provide visual enhancement to the curtainwall, and wherein the shadow box component comprises a piece of glass, a metal panel, painted panels or mirrors, and wherein the first side of the unit frame faces an exterior of the building and the second side of the unit frame faces an interior of the building.

2. The method of claim 1, wherein the secondary cassette is an insulation secondary cassette.

3. The method of claim 1, wherein the in-fill cassette first interior portion comprises the shadow box component.

4. The method of claim 1, wherein the shadow box component comprises a vision enhancement panel.

5. The method of claim 4, wherein the vision enhancement panel comprises a painted panel.

6. The method of claim 4, wherein the vision enhancement panel comprises a mirror panel.

7. The method of claim 1, wherein installing the in-fill cassette without wet sealant and installing the secondary cassette without wet sealant are each dry-fit processes.

8. The method of claim 1, wherein installing the in-fill cassette and installing the secondary cassette occurs at a manufacturing facility prior to shipment to an assembly facility or a construction site.

* * * * *